US009175559B2

(12) United States Patent
Dowla et al.

(10) Patent No.: US 9,175,559 B2
(45) Date of Patent: Nov. 3, 2015

(54) IDENTIFICATION OF CASING COLLARS WHILE DRILLING AND POST DRILLING USING LWD AND WIRELINE MEASUREMENTS

(75) Inventors: Najmud Dowla, Katy, TX (US); John C. Rasmus, Richmond, TX (US); Abhijeet Nayan, Bihar (IN); Taesoo Kim, East Perth (AU); Richard J. Radtke, Pearland, TX (US); Michael Evans, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 619 days.

(21) Appl. No.: 13/122,127

(22) PCT Filed: Oct. 2, 2009

(86) PCT No.: PCT/US2009/059369

§ 371 (c)(1),
(2), (4) Date: Aug. 19, 2011

(87) PCT Pub. No.: WO2010/040045

PCT Pub. Date: Apr. 8, 2010

(65) Prior Publication Data

US 2011/0290011 A1 Dec. 1, 2011

Related U.S. Application Data

(60) Provisional application No. 61/102,400, filed on Oct. 3, 2008.

(51) Int. Cl.
*E21B 47/09* (2012.01)
*E21B 17/08* (2006.01)

(52) U.S. Cl.
CPC ..... *E21B 47/09* (2013.01); *E21B 17/08* (2013.01)

(58) Field of Classification Search
CPC .... E21B 47/09; E21B 47/091; E21B 47/0905
USPC ..... 73/152.57
See application file for complete search history.

(56) References Cited

U.S. PATENT DOCUMENTS 2,156,519 A * 5/1939 Walker ..... 181/105
2,201,311 A * 5/1940 Halliburton ..... 181/105

(Continued)

FOREIGN PATENT DOCUMENTS

WO WO 2007120072 A1 * 10/2007 ..... G01V 3/20

OTHER PUBLICATIONS

Halliburton "Cased-Hole Wireline Services" 2008, Chapter 4, pp. 4-1 to 4-56.*

*Primary Examiner* — John Fitzgerald
(74) *Attorney, Agent, or Firm* — John Vereb

(57) ABSTRACT

Systems and methods identify and/or detect one or more features of a well casing by utilizing one or more downhole measurements obtainable by a downhole component. The one or more features of the well casing are identifiable and/or detectable from the one or more measurements associated with one or more properties of the one or more features of the well casing. The one or more measurements for indentifying and/or detecting a presence and/or a location of the one or more features of the well casing include sonic measurements, nuclear measurements, gamma ray measurements, photoelectric measurements, resistivity measurements and/or combinations thereof.

17 Claims, 10 Drawing Sheets

(56) References Cited

U.S. PATENT DOCUMENTS

| | | | | | |
|---|---|---|---|---|---|
| 2,459,499 | A | * | 1/1949 | Castel | 340/678 |
| 2,476,137 | A | * | 7/1949 | Doll | 166/254.1 |
| 2,580,544 | A | * | 1/1952 | Herzog | 250/262 |
| 2,602,833 | A | * | 7/1952 | Swift | 324/221 |
| 2,768,684 | A | * | 10/1956 | Castel et al. | 340/854.2 |
| 2,985,822 | A | * | 5/1961 | Georgi | 324/221 |
| 3,106,960 | A | * | 10/1963 | Doak | 166/66 |
| 3,177,941 | A | * | 4/1965 | Conrad | 166/64 |
| 3,212,601 | A | * | 10/1965 | Summers | 340/854.2 |
| 3,295,628 | A | * | 1/1967 | Summers | 367/35 |
| 3,306,102 | A | * | 2/1967 | Lebourg | 73/152.05 |
| 3,431,488 | A | * | 3/1969 | De La Torre et al. | 340/854.2 |
| 3,434,046 | A | * | 3/1969 | Lorenzino, Jr. et al. | 340/854.2 |
| 3,504,758 | A | * | 4/1970 | Dueker | 181/104 |
| 3,512,407 | A | * | 5/1970 | Zill | 73/152.15 |
| 4,382,290 | A | * | 5/1983 | Havira | 367/35 |
| 4,459,479 | A | | 7/1984 | Smith et al. | |
| 4,551,823 | A | * | 11/1985 | Carmichael et al. | 367/35 |
| 4,685,092 | A | * | 8/1987 | Dumont | 367/35 |
| 4,709,357 | A | * | 11/1987 | Maki, Jr. | 367/35 |
| 4,733,380 | A | * | 3/1988 | Havira | 367/35 |
| 4,791,619 | A | * | 12/1988 | Liu | 367/35 |
| 4,805,156 | A | * | 2/1989 | Attali et al. | 367/35 |
| 4,809,236 | A | * | 2/1989 | Hsu et al. | 367/28 |
| 4,912,683 | A | * | 3/1990 | Katahara et al. | 367/25 |
| 5,081,611 | A | * | 1/1992 | Hornby | 367/25 |
| 5,275,038 | A | * | 1/1994 | Sizer et al. | 73/152.02 |
| 5,279,366 | A | * | 1/1994 | Scholes | 166/254.2 |
| 5,361,838 | A | * | 11/1994 | Kilgore | 166/254.2 |
| 5,485,745 | A | * | 1/1996 | Rademaker et al. | 73/152.39 |
| 5,543,617 | A | * | 8/1996 | Roscoe et al. | 250/259 |
| 5,635,712 | A | * | 6/1997 | Scott et al. | 250/260 |
| 5,717,334 | A | * | 2/1998 | Vail et al. | 324/368 |
| 5,720,345 | A | | 2/1998 | Price et al. | |
| 5,740,864 | A | * | 4/1998 | de Hoedt et al. | 166/387 |
| 5,987,385 | A | | 11/1999 | Varsamis et al. | |
| 5,996,711 | A | * | 12/1999 | Ohmer | 175/61 |
| 6,031,381 | A | * | 2/2000 | Vail et al. | 324/716 |
| 6,249,122 | B1 | * | 6/2001 | Vail et al. | 324/368 |
| 6,520,264 | B1 | * | 2/2003 | MacKenzie et al. | 166/385 |
| 6,577,144 | B2 | * | 6/2003 | Vail et al. | 324/716 |
| 6,641,432 | B1 | | 11/2003 | Ouyoung | |
| 6,654,688 | B1 | * | 11/2003 | Brie et al. | 702/2 |
| 6,815,946 | B2 | | 11/2004 | Yoo | |
| 6,866,306 | B2 | | 3/2005 | Boyle et al. | |
| 6,896,056 | B2 | * | 5/2005 | Mendez et al. | 166/254.2 |
| 7,077,200 | B1 | * | 7/2006 | Adnan et al. | 166/250.01 |
| 7,150,317 | B2 | * | 12/2006 | Barolak et al. | 166/254.2 |
| 7,202,671 | B2 | | 4/2007 | Strack | |
| 7,302,841 | B2 | * | 12/2007 | Estes | 73/152.56 |
| 7,413,021 | B2 | | 8/2008 | Madhavan et al. | |
| 7,698,937 | B2 | * | 4/2010 | Neidhardt | 73/152.57 |
| 7,784,338 | B2 | * | 8/2010 | Estes | 73/152.56 |
| 7,784,339 | B2 | * | 8/2010 | Cook et al. | 73/152.57 |
| 7,900,699 | B2 | * | 3/2011 | Ramos et al. | 166/250.01 |
| 7,984,755 | B2 | * | 7/2011 | Serebrianski et al. | 166/65.1 |
| 8,074,713 | B2 | * | 12/2011 | Ramos et al. | 166/255.1 |
| 8,456,166 | B2 | * | 6/2013 | DePavia et al. | 324/338 |
| 2002/0016675 | A1 | * | 2/2002 | Vail et al. | 702/2 |
| 2003/0010495 | A1 | * | 1/2003 | Mendez et al. | 166/255.1 |
| 2004/0176911 | A1 | * | 9/2004 | Bratton et al. | 702/6 |
| 2005/0036403 | A1 | * | 2/2005 | Leggett et al. | 367/32 |
| 2005/0205248 | A1 | * | 9/2005 | Barolak et al. | 166/66.5 |
| 2005/0241824 | A1 | * | 11/2005 | Burris et al. | 166/255.1 |
| 2005/0269083 | A1 | * | 12/2005 | Burris et al. | 166/255.2 |
| 2006/0260391 | A1 | * | 11/2006 | Harthorn et al. | 73/152.57 |
| 2008/0262735 | A1 | * | 10/2008 | Thigpen et al. | 702/6 |
| 2009/0045075 | A1 | * | 2/2009 | Serebrianski et al. | 205/790.5 |
| 2011/0139447 | A1 | * | 6/2011 | Ramos et al. | 166/254.2 |
| 2011/0147233 | A9 | * | 6/2011 | Serebrianski et al. | 205/790.5 |
| 2011/0253364 | A1 | * | 10/2011 | Mosse et al. | 166/254.2 |
| 2011/0308789 | A1 | * | 12/2011 | Zhang et al. | 166/250.01 |
| 2014/0216734 | A1 | * | 8/2014 | Hupp | 166/255.1 |

* cited by examiner

IDENTIFICATION OF CASING COLLARS WHILE DRILLING AND POST DRILLING USING LWD AND WIRELINE MEASUREMENTS

CROSS-REFERENCE TO RELATED APPLICATIONS

The current application is a 371 of PCT/US2009/059369, which was filed on Oct. 2, 2009, which claims priority to U.S. Provisional Patent Application Serial No.: 61/102,400, filed on Oct. 3, 2008. The entirety of the foregoing applications is incorporated herein by reference.

FIELD OF THE INVENITON

The invention relates to systems and methods for identifying and/or detecting one or more features of a wellbore by utilizing one or more downhole measurements. For example, the systems and methods may identify and/or detect one or more features of a well casing by utilizing one or more measurements detectable by a downhole component. The one or more measurements may be based on one or more properties associated with the well casing and/or the one or more features of the well casing. The one or more measurements may be utilized for indentifying and/or detecting a presence and/or a location of one or more features of the well casing. The one or more measurements may exclude electromagnetic measurements and/or may include, for example, sonic measurements, nuclear measurements, gamma ray measurements, photoelectric measurements, resistivity measurements and/or the like.

BACKGROUND OF THE INVENTION

Traditionally, a downhole detector is utilized for detecting one or more features of a well casing in a well by utilizing one or more electromagnetic-fields generated by the downhole detector.

Certain downhole oilfield applications, such as, for example, perforating applications, require the ability to be able to position a downhole tool at a particular known position in the well. For example, a wireline tool assembly including one or more instruments is lowered downhole into the well via a wireline such that the wireline tool assembly is positioned at a particular position or depth in the well. A depth counter may be used at the Earth's surface to track a length of dispensed cable to approximate the depth of the wireline tool assembly in the well. However, the depth counter may not precisely indicate the depth of the wireline tool assembly in the well because stretching and/or flexing in the downhole wireline may occur due to the weight of the wireline tool assembly. As a result, other depth determination techniques are necessary to accurately determine the depth of the wireline tool assembly in the well.

Other depth determination techniques include use of a depth control log which is utilized to generate a casing collar locator log for identifying and/or detecting locations of features of the well casing, such as, for example, one or more casing collar joints of the well casing. The casing collar locator log is, typically, generated by ascending and descending a downhole detector in a well to determine locations and depths of one or casing collar joints of the well casing. Casing collar joints are locations in the well casing whereby casing segments are coupled together. Each casing collar joint includes a casing collar coupling two adjacent casing segments together.

The wireline tool assembly may include a casing collar locator. The casing collar locator of the wireline tool assembly is moved downhole and/or uphole via the wireline to collect measurements and/or information associated with well casing. As a result, the casing collar locator may detect and/or identify locations and/or depths of the casing collar joints of the well casing. The measurements and/or information detected by the casing collar locator may be used to generate the depth control log. When the casing collar locator indicates detection of a casing collar joint, a coarse depth that is provided by the depth counter at the Earth's surface is used to locate the corresponding casing collar joint on the depth control log. As a result, the depth of the wireline tool assembly may be determined because the depth control log precisely illustrates the depth of the detected casing collar joint. From this determination, an error compensation factor may be derived. Then, for example, when a perforating gun is positioned downhole, the error compensation factor is used to compensate the reading of the depth counter to precisely position the gun within the well.

Conventionally, the casing collar locator is a passive device that utilizes principles of electromagnetic inductance to detect the casing collar joints of the well casing. The casing collar locator, typically, includes an electrical coil winding through which an electromagnetic flux field is created by one or more permanent magnets passes. When a change occurs in the effective magnetic permeability of the surroundings, such as in the presence of a casing collar joint, a voltage is induced in the coil winding due to the corresponding change or disturbance in the electromagnetic flux field. Therefore, as the casing collar locator passes the casing collar joints, the change in permeability, which is caused by such things as, for example, the presence of the air gap between adjacent well casing segments and the casing collar, causes a change in the electromagnetic flux field to generate or induce a signal across the coil winding. This generated or induced signal may be communicated uphole and/or observed at a surface of the well. Thus, with this technique of detecting casing collar joints, the casing collar locator must be in continual uphole or downhole motion to produce the signal indicating detection of the casing collar joint.

The quality of the signal may be highly dependent on a degree to which the magnetic permeability changes, or is disturbed. For example, the higher the rate of change in the permeability experienced by the electromagnetic flux field, the higher the induced signal. The degree to which the electromagnetic field is disturbed depends on factors such as, for example, distance or gap (hereinafter "stand-off") between the casing collar locator and the well casing, electromagnetic properties, such as, for example, permeability of the surrounding well casing, and a degree of change in geometry or bulk-mass of the casing, such as, for example, an abrupt and/or drastic change causing a sufficient and/or rapid disturbance in the flux field.

If the electromagnetic field is not sufficiently and/or rapidly disturbed, the resulting signal may be too small to be detected at the surface of the well. The signal-to-noise ratio of the signal produced downhole typically places a limit on the degree to which the signal can be boosted, or amplified. As a result, it may be very difficult to detect casing collar joints made from a material having a low magnetic permeability. Likewise, joints having no casing collars are difficult to detect, particularly, if the joints are "flush" and/or without air gaps.

Another difficulty associated with the conventional casing collar locator is associated with a mass and/or a size of the conventional casing collar locator. For example, the conventional casing collar locator may be made up of many different components, such as, for example, two or more permanent magnets, one or more coils, and one or more coil cores, or bobbins. As a result, the combination of the components of the casing collar locator imparts a large mass to the conventional casing collar locator. The resulting large mass of the casing collar locator may cause a significant force to be exerted on the casing collar locator during perforating operations due to high acceleration and/or shock that may affect the resulting large mass. The force exerted on the casing collar locator may damage the casing collar locator if measures are not undertaken to properly pack and/or protect the casing collar locator in the well.

The combination of the components of the casing collar locator often results in the casing collar locator being bulky in size. For example, the casing collar locator may extend from six inches to eighteen inches, not including the pressure housing and connections. As a result, a tool string which may house the casing collar locator may, thus, be long and cumbersome. A length of the tool string is very important, particularly, when the tool string is conveyed on a wireline and/or when working with high well pressure. Having a tool string with a long length can present major operational and safety problems with pressure control equipment, such as, for example, a lubricator and/or a riser pipe. Therefore, it is important to conserve every inch in length of a tool string, particularly, in perforating applications.

Another depth determination technique includes measuring each casing segment at the Earth's surface before the casing segments are coupled together to form the well casing and lowered downhole into the well. By measuring each casing segment at the Earth's surface, a total number of casing segments necessary to insure that formations of interest have casing segments placed or positioned thereon may be determined A length of each casing segment, typically, lies within a variance of tens of inches of each other. Since each casing segment has a unique length, a unique pattern of casing segment lengths are distributed downhole throughout the well and recorded at the Earth's surface.

The casing collar of each casing segment refers to a top end and/or a bottom end of each casing segments which have threads thereon for coupling the casing segments together. Thus, the casing collars of the casing segments have a greater thickness at threads located at the top and bottom ends of each casing segment than the thickness of casing segments between the top and bottom ends of each casing segment. The greater thickness at the ends of each casing segment allows locations of the top end, the bottom end, and the length of each casing segment to be identified and/or detected by, for example, a downhole electromagnetic-field based detector lowered downhole into the well. By identifying the unique pattern of casing segment lengths with the downhole electromagnetic-field based detector, a depth and/or location of the detector, casing segments and/or casing collars within the well may be determined For example, the downhole electromagnetic-field based detector may be utilized for measuring and/or determining formation properties, relative positions of the casing collar joints, formation layers, and/or total depth.

However, the downhole electromagnetic-field based detector must be lowered into the well using the wireline. And as discussed above, the precise depth of the detector may not be identifiable because the wireline may stretch and/or flex due to the weight of the downhole detector. Thus, other depth determination techniques are necessary in order to accurately determine or identify locations and depths associated downhole detectors, downhole wireline tool assemblies and/or features of the well casing.

DETAILED DESCRIPTION OF EMBODIMENTS

The invention relates to systems and methods for identifying and/or detecting a feature of well casing by utilizing a downhole measurement associated with a well casing or formations or cement located adjacent to the well casing. The systems and methods may identify and/or detect features of the well casing by utilizing measurements of the one or more properties associated with the well casing detectable by a downhole component. The well casing may be made of steel and may be positioned within a portion of the well during or after drilling of the well. The one or more features of the well casing identifiable and/or detectable may include, for example, casing collars, casing collar joints and/or cement adjacent to the well casing. The one or more measurements utilized to identify and/or detect the one or more features of the well casing may be detectable by the downhole component which may include a logging-while-drilling (hereinafter "LWD") tool and/or a wireline configurable tool. The one or more measurements for indentifying and/or detecting the features of the well casing may include, for example, sonic measurements, nuclear measurements, gamma ray measurements, photoelectric measurements, resistivity measurements and/or the like. Moreover, the one or more measurements for identifying and/or detecting the features of the well casing may not include or may exclude electromagnetic measurements.

Figure 1:
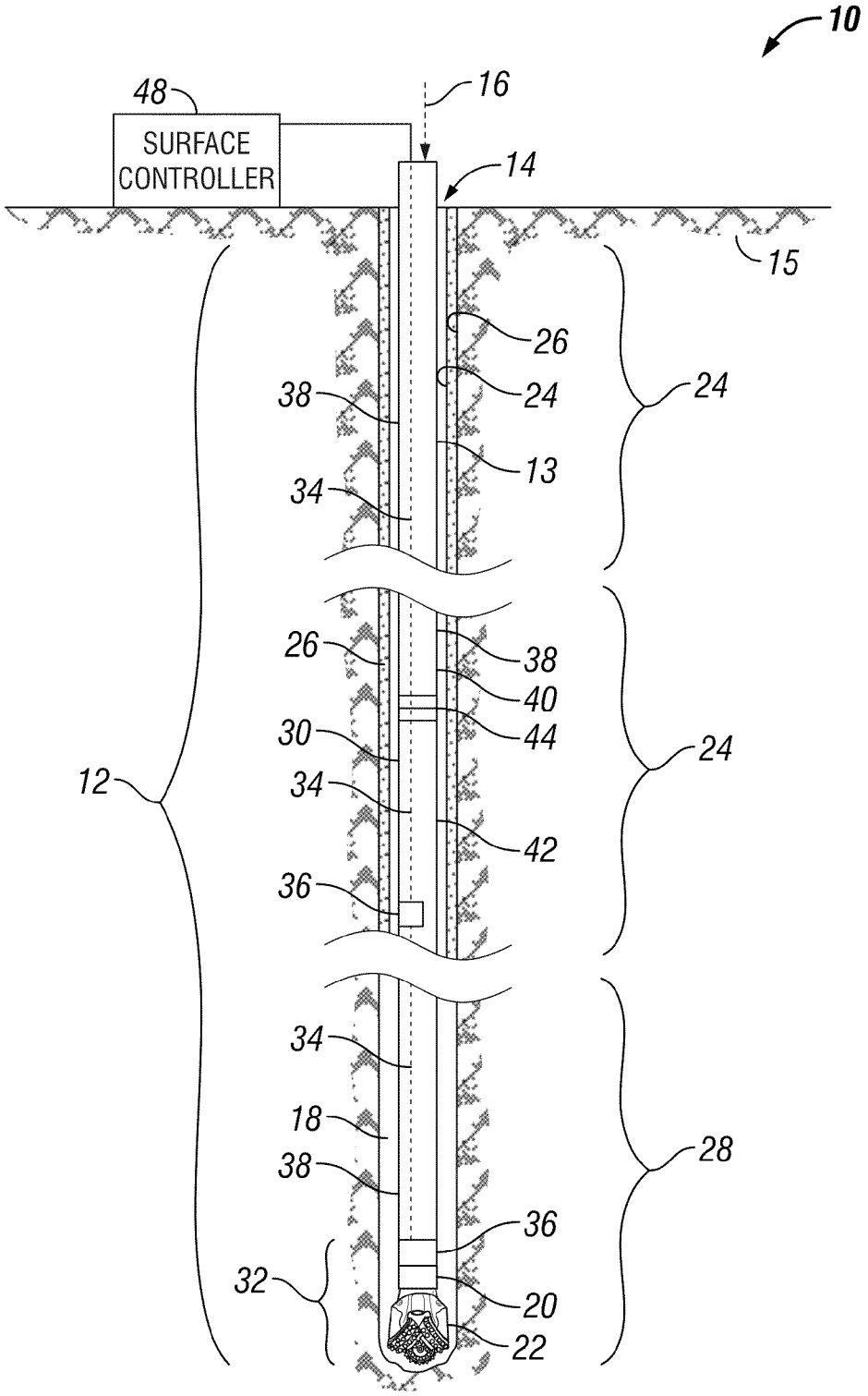
FIG. 1 illustrates a schematic diagram of a drilling system in an embodiment of the present invention and which can be used in practicing embodiments of the method of the present specification.

Referring now to the drawings wherein like numerals refer to like parts, FIG. 1 schematically depicts a drilling system 10, which may be on-shore or off-shore, in which the present systems and methods for identifying and/or detecting one or more features of a well casing may be implemented. The drilling system 10 may be an on-shore drilling system 10 with a drill string 12 comprising a string of drill pipe 13. During the drilling of a wellbore 14 in subsurface formations 15, a surface pumping system (not shown in the drawings) may deliver mud flow 16 to the central passageway of the drill pipe 13, and the mud flow 16 may propagate downhole through the drill pipe 13. Near the bottom end of the drill pipe 13, the mud flow 16 may exit the drill pipe 13 at nozzles (not shown in the drawings) and may return uphole to the surface pumping system via an annulus 18 of the well. As an example, the circulating mud flow 16 may actuate a downhole mud motor 20 that may, in turn, rotate a drill bit 22 of the drill pipe 13. Embodiments of the present invention may be utilized with vertical, horizontal and/or directional drilling.

The drilling system 10 of FIG. 1 may depict a particular stage of the well during its drilling, post drilling and/or completion. In this stage, upper segments 24 of the wellbore 14 may be formed through the operation of the drill pipe 13 and may be lined with and supported by a well casing 26 that has been installed in the upper segments 24. The well casing 26 may be made of material, such as, for example, steel and/or the like. It should be understood that the well casing 26 may be made from any material as known to one of ordinary skill in the art.

For example, the wellbore 14 may extend below the upper segments 24 into a lower, uncased segment 28. Thus, drilling operations may be interlaced with installation operations of the well casing 26. However, the drill pipe 13 may alternatively be used as part of the well completion. In this manner, called "casing drilling," the drill pipe 13 may be constructed to line and support the wellbore 14 so that at the conclusion of the drilling operation, the drill pipe 13 may be left in the well to perform the traditional function of a well casing 26.

The drilling operation and/or the downhole formations through which the wellbore 14 extends may be monitored at the surface of the well via measurements that are acquired downhole. For this purpose, the drill pipe 13 may have a wired drill pipe infrastructure 30 (hereinafter "WDP 30") for purposes of establishing one or more communication link(s) between the surface of the well and a downhole components 36 may acquire measurements and/or may be part of a bottom hole assembly 32 (hereinafter "BHA 32") of the drill pipe 13. As non-limiting examples, the WDP 30 may provide a cable within each drill pipe 13 that is communicatively coupled at each pipe joint. Communication through the WDP 30 may be bidirectional, in that the communication may be from the surface of the well to the BHA 32 and/or from the BHA 32 to the surface of the well. Moreover, many variations and uses of the WDP 30 are contemplated and are within the scope of the present invention. Examples include U.S. Pat. Nos. 6,641,434 (Boyle et al.), 6,866,306 (Boyle et al.) and 7,413,021 (Madhara et al.) each assigned to the assignee of the present application and hereby incorporation by reference in their entire.

The WDP 30 may include one or more communication line segments 34 embedded in a housing of the drill pipe 13. The one or more communication line segments 34 may be, for example, fiber optic line segments, a coaxial cable, electrical cable segments, or another device for transferring data. It should be understood that the communication line segments 34 may be any communication line segments as known to one of ordinary skill in the art. The present invention should not be deemed as limited to a specific number of downhole components incorporated within the WDP 30 of the drilling system 10.

The WDP 30 may contain multiple communication lines that extend between the surface of the well and the BHA 32, with each communication line being formed from serially connected communication line segments 34, the downhole component 36 and/or communication connectors within the WDP joints 44.

In embodiments, the drill pipe 13 may include the one or more downhole components 36 which may be a downhole tool comprising a telemetry module. Communication signals may be received by the telemetry module at the BHA 32 from a surface controller 48 via the bidirectional communication provided by the telemetry module. The communication signals received from the surface controller 48 may control processes such as directional drilling and/or functions or operations of the one or more downhole components 36 associated with the drill pipe 13. The communication signals from the surface controller 48 may be transmitted downhole to the one or more downhole components. As a result, the bidirectional communication may improve measurement and control, during drilling (and pausing and tripping) processes, to achieve improved operation and decision making.

The telemetry module of the one or more downhole components 36 may communicate with the surface controller 48 via mud pulse telemetry, acoustic telemetry, electromagnetic telemetry and/or real time bidirectional drill string telemetry. It should be understood that the type of telemetry utilized by the telemetry module of the one or more downhole components 36 may be any type of telemetry capable of communicating with the surface controller 48 as known to one of ordinary skill in the art.

As a result, the one or more downhole components 36 of the drill pipe 13 may communicate with the surface controller 48 via communication signals that may be communicated over the WDP 30 and/or telemetry module of the one or more downhole components 36. In embodiments, the one or more downhole components 36 may receive one or more signals, such as, for example, control and/or data signals from the WDP 30 via the communication line segments 34. Further, the one or more downhole components 36 may transmit one or more signals uphole to the surface controller 48 via the WDP 30 or the telemetry module. Moreover, the drill pipe 13 may include various other features, such as, for example, a drill collar, an under-reamer and/or the like, as the depiction of the drill pipe 13 in FIG. 1 is simplified for purposes of illustrating certain aspects of the drill pipe 13 related to the well casing 26, the WDP 30 and/or the one or more downhole components 36. It should be understood that the BHA 32 may include any number of downhole components 36 and/or other features as known to one of ordinary skill in the art.

For example, the one or more downhole components 36, in embodiments, may be housed in a drill collar, as is known in the art, and may contain one or more known types of telemetry, survey or measurement tools, such as, for example, one or more LWD tools, one or more measuring-while-drilling tools (hereinafter "MWD tools"), one or more near-bit tools, one or more on-bit tools, and/or one or more wireline configurable tools.

In embodiments, the LWD tools of the one or more downhole components 36 may include capabilities for measuring, processing, and storing information, as well as for communicating with surface equipment. The LWD tools may indentify, detect and/or measure one or more properties associated with the formation 15, the drill string 12, the well casing 26 and/or the features of the well casing 26. Additionally, the one or more LWD tools may include one or more of the following types of logging and/or measuring devices: a resistivity measuring device; a directional resistivity measuring device; a sonic measuring device; a nuclear measuring device; a nuclear magnetic resonance measuring device; a pressure measuring device; a seismic measuring device; an imaging device; a formation sampling device; a gamma ray measuring device; a density and photoelectric measuring device; a neutron porosity device; a bit resistivity measuring device, a ring resistivity measuring device, a button resistivity measuring device and/or a borehole caliper device. In an embodiment, the LWD tool may include, for example, a compensated density neutron tool, an azimuthal density neutron tool, a resistivity-at-the-bit tool, hookload sensor and/or a heave motion sensor. It should be understood that the one or more downhole components 36 may be any type of LWD tool as known to one or ordinary skill in the skill.

In embodiments, the MWD tools of the one or more downhole components 36 may include one or more devices for measuring characteristics associated with the drill bit 22 and/or the drill string 12. The one or more MWD tools may include one or more of the following types of measuring devices: a weight-on-bit measuring device; a torque measuring device; a vibration measuring device; a shock measuring device; a stick slip measuring device; a direction measuring device; an inclination measuring device; a gamma ray measuring device; a directional survey device; a tool face device; a borehole pressure measuring device; and/or a temperature device. The one or more MWD tools may detect, collect and/or log data and/or information about the conditions at the drill bit 22, around the formation 15, at a front of the drill string 12 and/or at a distance around the drill strings 12. The one or more MWD tools may provide telemetry for operating rotary steering tools. It should be understood that the one or more downhole components 36 may be any type of MWD tool as known to one of ordinary skill in the art.

The wireline configurable tools of the one or more downhole components 36 may be a tool commonly conveyed by wireline cable as known to one having ordinary skill in the art. The wireline configurable tools may form a wireline tool string which may include multiple separate tools which may perform multiple operations at the same time or at different times. For example, the wireline configurable tool may be a logging tool for sampling, detecting and/or measuring properties associated with the formation 15, the drill string 12, the well casing 26 and/or features of the well casing 26. The wireline configurable tools may be one or more open hole electric line tool which may identify and/or detect one or more measurements, such as, for example, gamma radiation measurements, nuclear measurements, density measurements, neutron measurements, resistivity measurements, sonic measurements, ultrasonic measurements, magnetic resonance measurements, seismic measurements and/or porosity measurements. In embodiments, wireline configurable tools may be one or more cased hole electric line tools, such as, for example, a sonic tool, an ultrasonic tool, an azimuthal density neutron tool, a cement bond tool, a casing collar locator, a gamma perforating tool, a well completion tool and/or a setting tool. It should be understood that the one or more downhole components 36 may be any type of wireline configurable tool as known to one of ordinary skill in the art.

The one or more downhole components 36 may comprise, include or incorporate a BHA power source, such as, for example, the downhole mud motor 20 or any other power generating source as known to one of ordinary skill in the art. The BHA power source may produce and generate electrical power or electrical energy to be distributed throughout the BHA 32 and/or to power the one or more downhole components 36.

Figure 2:
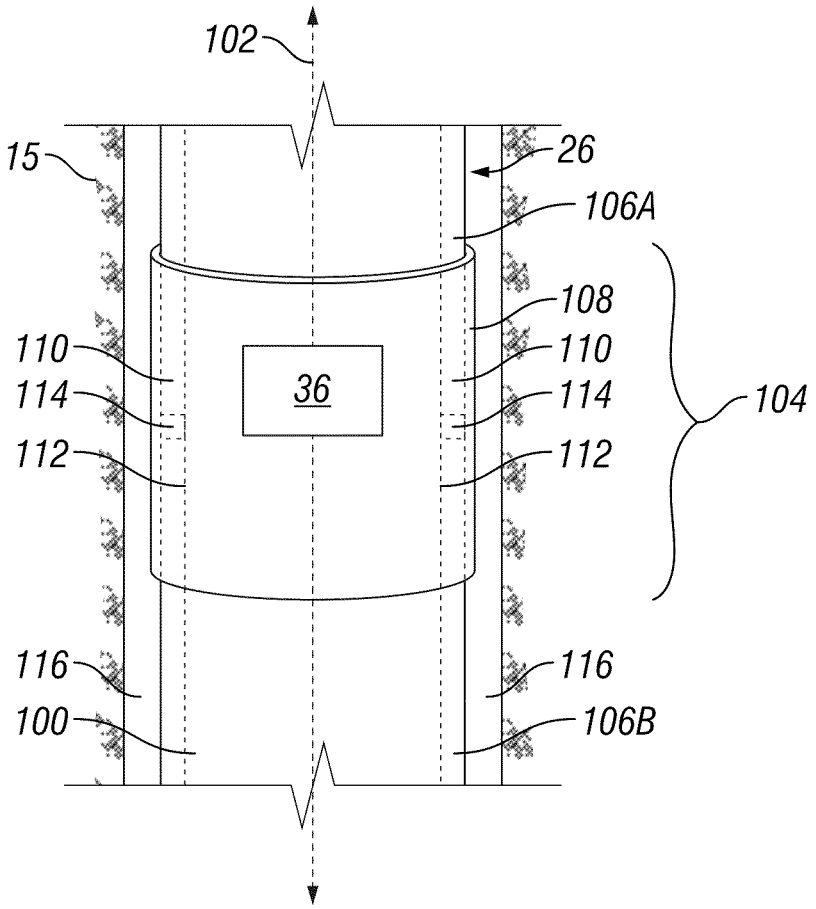
FIG. 2 illustrates a schematic diagram of a well casing and a downhole component in an embodiment of the present invention and which can be used in practicing embodiments of the method of the present specification.

As illustrated in FIG. 2, the downhole component 36, such as, for example, a LWD tool or a wireline configurable tool may be used to locate one or more features of the well casing 26 surrounding and/or adjacent to the downhole component 36. The well casing 26 and/or the one or more features of the well casing 26 may include, for example, a valve, a casing collar joint or other tubular structure which may have one or more properties measurable and/or detectable by the downhole component 36. Additionally, the well casing 26 may have a passageway for receiving the downhole component 36. The one or more properties associated with and/or related to the well casing 26 and/or the one or more features of the well casing 26 may include, for example, physical properties, mechanical properties, electrical properties, thermal properties, chemical properties, magnetic properties, optical properties, acoustical properties, radiological properties and/or atomic properties. It should be understood that the one or more properties associated with the well casing 26 and/or the one or more features of the well casing 26 may be any type of properties measurable and/or detectable by the downhole component 36 and known to one of ordinary skill in the art.

In embodiments, the downhole component 36 may pass through a central passageway 100 of the well casing 26 along an axis 102 within the well casing 26 for purposes of identifying and/or detecting the one or more features of the well casing 26, such as a casing collar joint 104 by measuring and/or detecting the one or more properties of the well casing 26 and/or the casing collar joint 104. Unlike conventional casing collar detectors, the downhole component 36 may or may not need to move along the axis 102 to measure and/or detect the properties of the well casing 26 and/or the casing collar joint 104. The downhole component 36 may measure and/or detect the one or more properties associated with the casing collar joint 104 and may transmit a signal to indicate and/or identify that the feature and/or the casing collar joint 104 of the well casing may be near and/or adjacent to the downhole component 36. Thus, while stationary or moving with respect to the features and/or the casing collar joint 104 of the well casing 26, the downhole component 36 may be used to detect and/or identify one or more features of the well casing 26.

In some embodiments of the invention, the properties associated with the well casing 26, the features of the well casing 26 and/or the casing collar joint 104 may be detectable and/or identifiable by measurements detectable and/or measurable by the downhole component 36. The measurements for detecting and/or identifying the one or more properties of the well casing 26 detectable and/or measureable by the downhole component 36 may include, for example, sonic measurements, ultrasonic measurements, nuclear measurements, gamma ray measurements, photoelectric measurements, resistivity measurements and/or the like. The measurements for detecting and/or identifying the one or more properties of the well casing 26 may not include or may exclude electromagnetic measurements.

The measurements of the one or more properties of the well casing 26 that may be detectable and/or measurable by the downhole component 36 may be affected differently by the properties associated with the features and/or the casing collar joint 104 of the well casing 26. By detecting and/or measuring the properties associated with the well casing 26, the downhole component 36 may identify and/or determine when the one or more of the features of the well casing 26, such as, for example, the casing collar joint 104 may be present and in proximity and/or adjacent to the downhole component 36.

For example, the casing collar joint 104 that is depicted in FIG. 2 may be formed from a union or coupling of well casing segments 106*a* and 106*b* which may be attached, connected and/or coupled together by a casing collar 108. A lower tapered end 110 of the upper casing segment 106*a* may extend into an upper portion of the casing collar 108, and an upper tapered end 112 of the lower casing segment 106*b* may extend into a lower portion of the casing collar 108. The lower tapered end 110 and the upper tapered end 112 (hereinafter "the ends 110, 112") may not meet and/or abut each other inside the casing collar 108, but rather, an air gap 114 may exist between the ends 110, 112. Thus, the combination of the air gap 114 and the casing collar 108 may create and/or result in substantially different measurements of properties detectable and/or measurable by the downhole component 36, when the downhole component 36 may be near or adjacent to the casing collar joint 104, than measurements of properties detectable and/or measurable when the downhole component 36 may be near a portion of the well casing 26 without the casing collar joint 104.

The measurements of the properties detected and/or measured by the downhole component 36 may provide an identification and/or a location of the features of the well casing 26, such as, for example, the casing collar joint 104. Because the measurements may be different when the downhole component 36 may be near or adjacent to the casing collar joint 104 than when the downhole component 36 may not be near the casing collar joint 104 and near, for example, a straight section of the well casing 26. As a result, a presence and/or a location of the casing collar joint 104 may be identified and/or detected by comparing the different measurements, detected and/or measured by the downhole component 36.

The downhole component 36 may be compared to a conventional casing collar locator that relies on a change in the sensed magnetic field to induce a signal on a winding for purposes of indicating detection of a casing collar joint. However, the conventional casing collar locator does not generate a signal if the locator is not moving. In contrast, the downhole component 36 may measure and/or detect the measurements of the properties associated with the well casing 26, the features of the well casing 26 and/or the casing collar joint 104, regardless of whether the downhole component 36 may be stationary or moving with respect to the well casing 26. The differences in the measurements obtained and/or measured by the downhole component 36 may be used to determine if one or more of the features of the well casing 26, such as, for example, the casing collar joints 104 may be identified and/or detected.

In embodiments, identification of the one or more casing collar joints 104 may be utilized to determine a measured depth based on and/or corresponding to the location of the one or more casing collar joints 104. The determined measured depth may be used to a downhole location for performing and/or executing a downhole action. The downhole action may include, for example, positioning a whipstock, side tracking a well and/or positioning a perforation tool. After the measured depth may be determined based on the locations of one or more casing collar joints 104, the downhole action may be performed and/or executed at the downhole location based on the measured depth.

In general, the changes, differences or disturbances between the measured and/or detected properties may be caused by, for example, changes in the geometry of the well casing 26; gaps in the well casing 26, such as, for example, the air gap 114; anomalies in the well casing 26, such as, for example, heavy pitting, cracks, or holes such as perforations; sudden changes in distance or stand-off between the downhole component 36 and the well casing 26; other changes in one or more properties associated with the well casing 26; and/or changes in the bulk-mass of the well casing 26.

Among the other features of the downhole component 36, in some embodiments, the downhole component 36 which may be a LWD tool which may be included in the drill string 12 or a wireline configurable tool may include a tubular housing (not shown in the drawings) having a longitudinal axis. The longitudinal axis may be generally aligned with the axis 102 of the well casing 26 when the downhole component 36 may be located inside the well casing 26. The housing of the downhole component 36 may protect and provide sealed containment for sensors (not shown in the drawings) and/or circuitry (not shown in the drawings) of the downhole component 36.

The housing of the downhole component 36 may be connected to a wireline cable (not shown in the drawings) that may extend to the Earth's surface to position the downhole component 36, to communicate signals, in real time, from the downhole component 36 to the Earth's surface and the surface controller 48 and/or to provide electrical power to the downhole component 36. The downhole component 36 may output and/or transmit one or more signals to the surface controller 48 that may be processed by the surface controller 48 for identifying the presence and/or location of the one or more features of the well casing 26, such as, for example, the casing collar joint 104. As a result, the downhole component 36 may identify and/or determine the presence and/or the location of the casing collar joint 104 and/or other features of the well casing 26 based on the signals received from the downhole component 36.

When the one or more features and/or the casing collar joint 104 of the well casing 26 has been detected, the downhole component 36 may communicate the one or more signals, in real time, identifying the one or more features and/or the casing collar joint 104 to the Earth's surface via one or more communication line segments 34 of the WDP 30 or the telemetry module of the one or more downhole components 36. For example, the downhole component 36 may establish communication with the wireline cable that extends to the Earth's surface. The downhole component 36 may communicate to the surface a direct indication of the properties associated with the one or more features or the casing collar joint 104 of the well casing 26 or, alternatively, may communicate an indication of the actual feature(s) and/or the casing collar joint 104 detected.

For example, the downhole component 36 may be a LWD sonic tool which may utilize sonic waves to measure and/or detect one or more properties associated with the casing collar joint 104, such as sonic absorption. The downhole component 36 may transmit sound waves towards the casing collar joint 104 and/or the well casing 26 and may have a receiver (not shown in the drawings) which may receive the sonic waves reflected from the casing collar joint 104 and/or the well casing 26.

Figure 3:
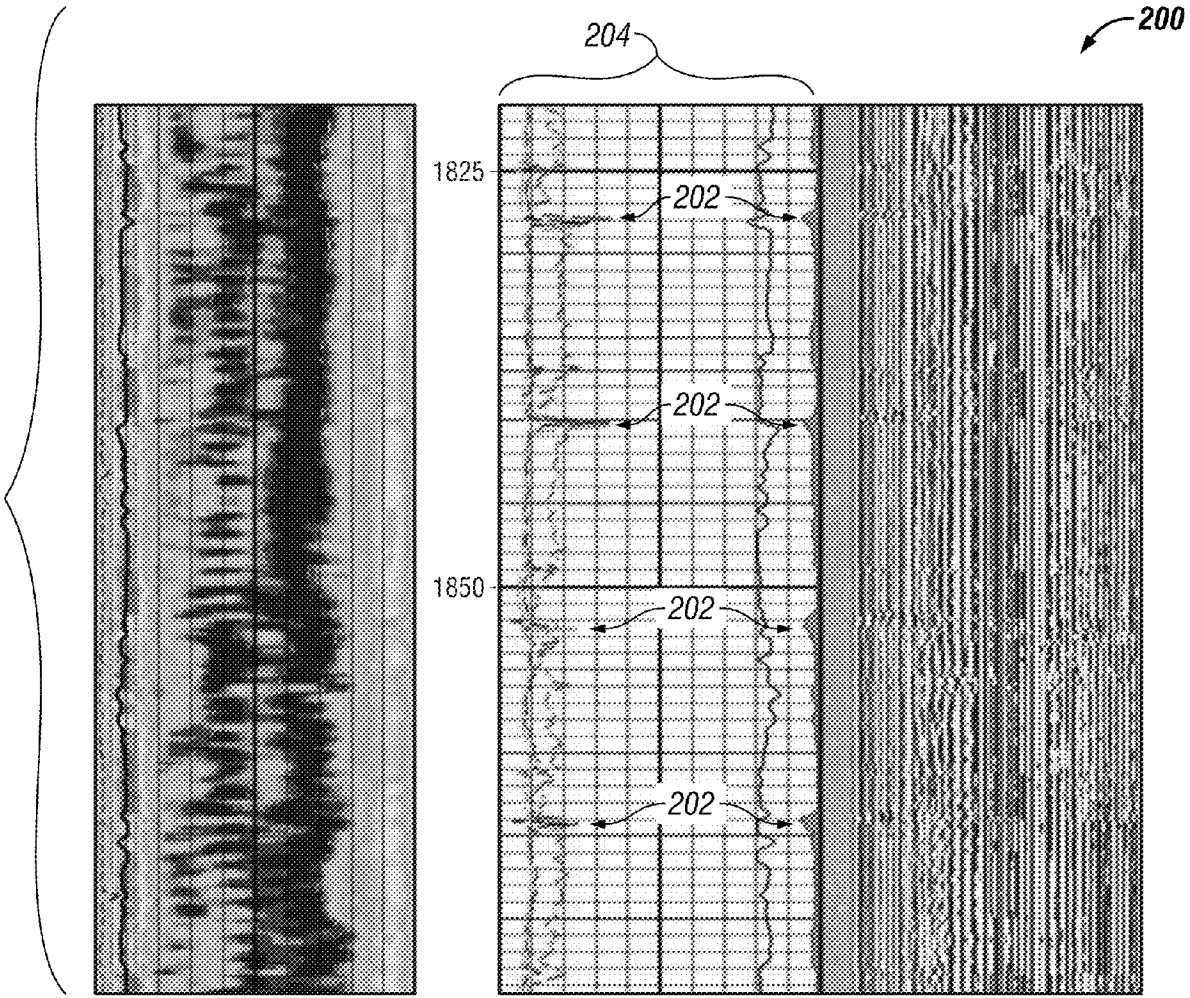
FIG. 3 illustrates a graph for identifying one or more features of a well casing in an embodiment of the present specification.

As shown in FIG. 3, graph 200 illustrates amplitudes for sound waves or waveforms received by the downhole component 36 and processed by the downhole component 36 and/or the surface controller 48. The amplitudes of the detected sound waves or waveforms may change when the casing collar joint 104 is near or adjacent to the downhole component 36. For example, the amplitude of the detected sound waves or waveforms may momentarily increase to one or more spikes 202 when the downhole component 36 is in the presence of and/or is adjacent to the casing collar joint 104 as shown in track 204 of FIG. 3. As a result, the downhole component 36 and/or the surface controller 48 may identify the presence and/or the location of one or more casing collar joint 104 based on the measurements and/or spikes 202 detected and obtained by the downhole component 36 when the downhole component 36 may be near or adjacent to the casing collar joint 104.

Figure 4:
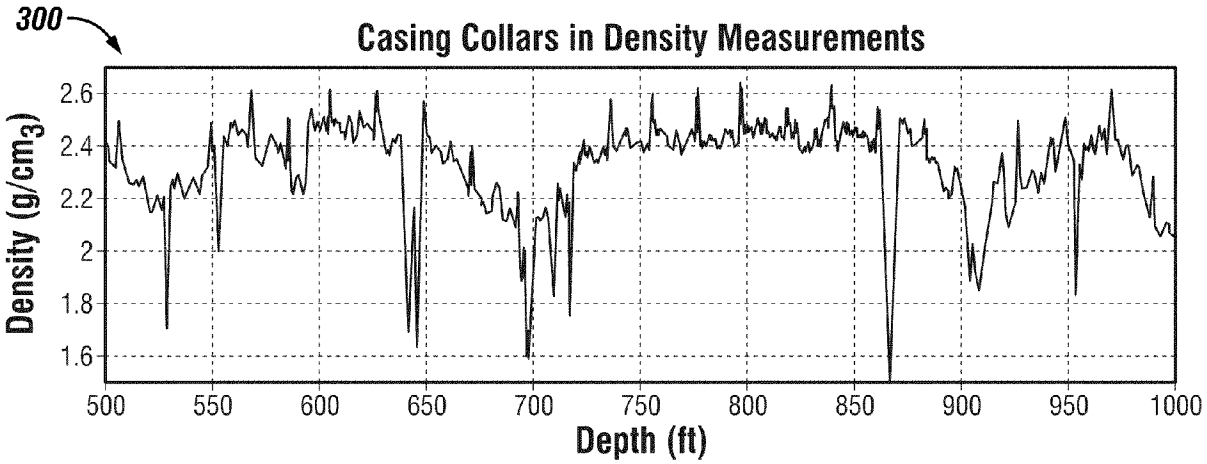
FIG. 4 illustrates a graph for identifying one or more features of a well casing via gamma-gamma density measurements in an embodiment of the present specification.
Figure 5:
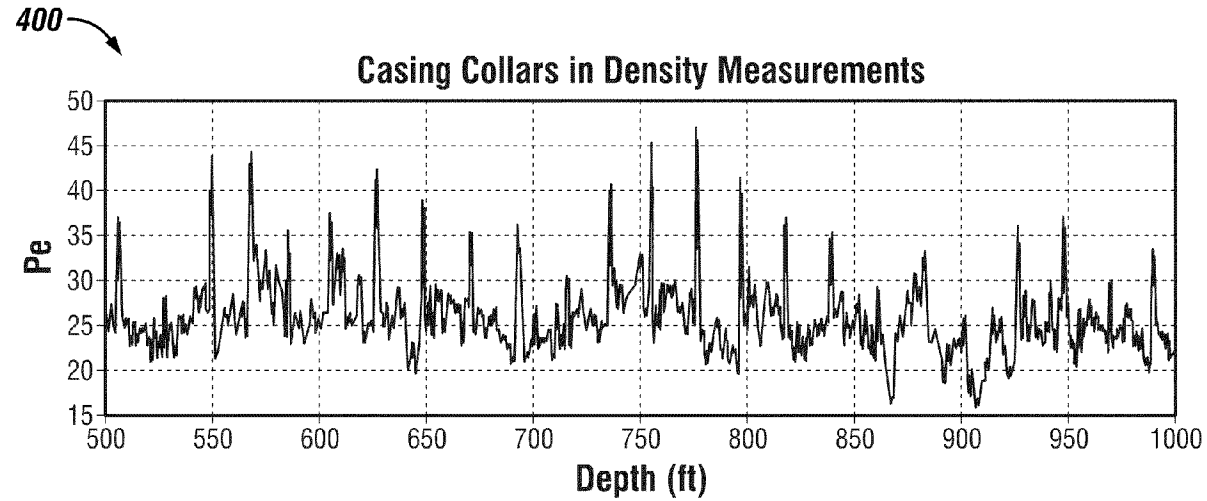
FIG. 5 illustrates a graph for identifying one or more features of a well casing via photoelectric type nuclear measurements in an embodiment of the present specification.

In embodiments, the downhole component 36 may be adapted to measure and/or detect, for example, gamma-gamma and photoelectric type nuclear density measurements to identify and/or detect the presence and/or the location of one or more casing collar joints 104 as shown in graphs 300 and 400 of FIGS. 4 and 5, respectively. The measured and detected gamma-gamma and photoelectric type nuclear density measurements may momentarily increase to larger values or upward spikes 202 at regular intervals which identify the presence and/or the location of the one or more casing collar joints 104. The upward spikes may represent or correspond to detection of a higher density in FIG. 4 and a higher photoelectric value in FIG. 5.

The downhole component 36 and/or the surface controller 48 may utilize one or more processing algorithms to analyze the measurements detected by the downhole component 36 and to identify the one or more casing collar joints 104. The identification of the one or more casing collar joints may be enhanced by insuring that the source and detectors of the downhole component 36 for the gamma-gamma and photoelectric type nuclear density measurements may be pressed up against the well casing 26 by, for example, a backup arm (not shown in the drawings). Other variations in the measurements may be unrelated to the casing collar joints 104 but may also be identified from the gamma-gamma and photoelectric type nuclear density measurements. The other variations or may be associated with the formation 15 or changes in a position of the well casing 26 with respect to the formation 15.

Figure 6:
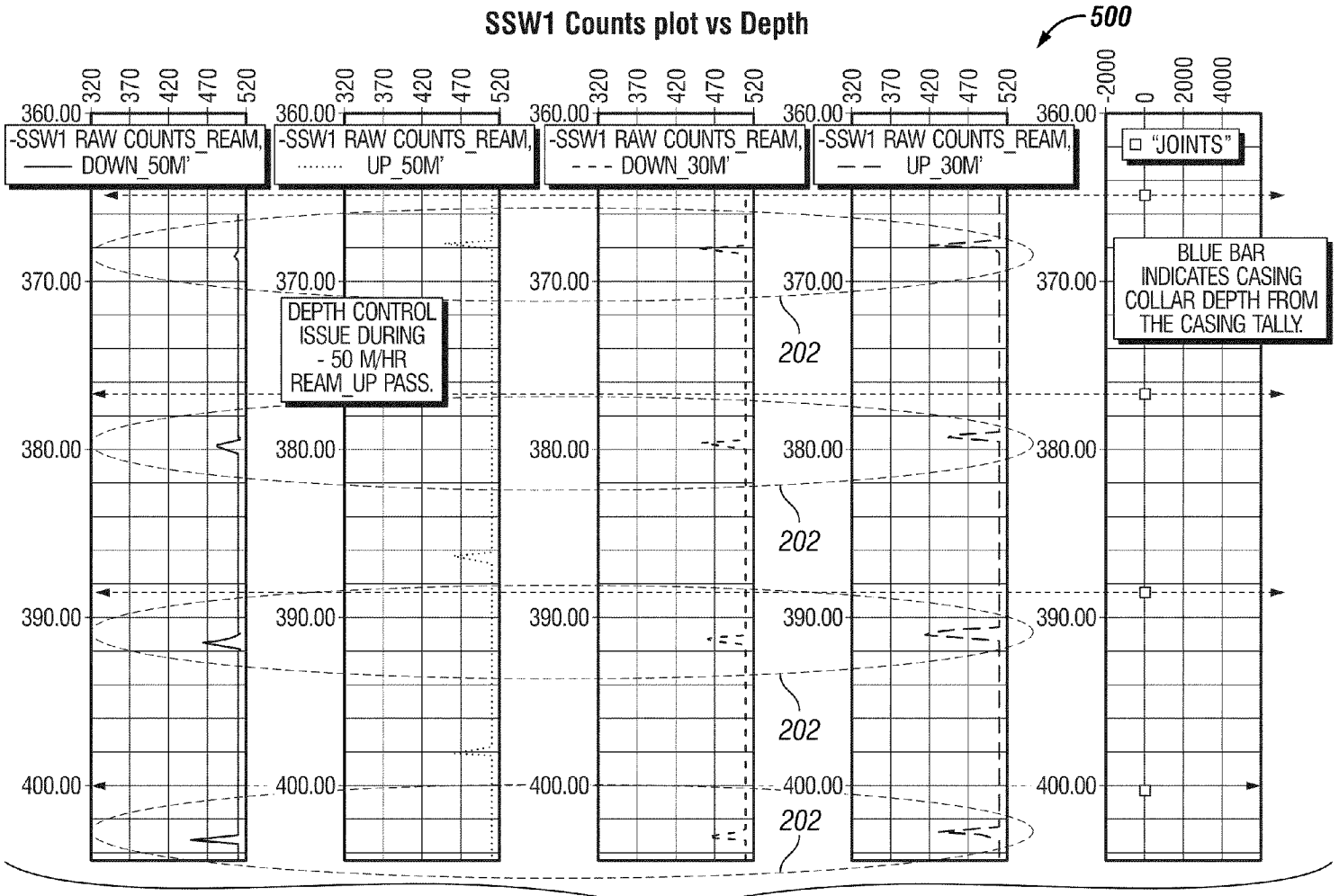
FIG. 6 illustrates a graph for identifying one or more features of a well casing via photoelectric type nuclear measurements obtained by a downhole tool in an embodiment of the present specification.

FIG. 6 illustrates a graph 500 for photoelectric type nuclear measurements detected by the downhole component 36 and processed by the downhole component 36 and/or the surface controller 48. Graph 500 in FIG. 6 may represent or correspond to scintillation detector count rates that may be utilized primarily in computation of bulk density and/or secondary in determination of gamma gamma density. The plotted count rates in each column of FIG. 6 may represent specific energy ranges obtained from a short spaced detector. These energy ranges may be associated with photoelectric measurements. Each column of FIG. 6 may represent a different pass over the same interval with varying speeds and/or varying directions.

Figure 7:
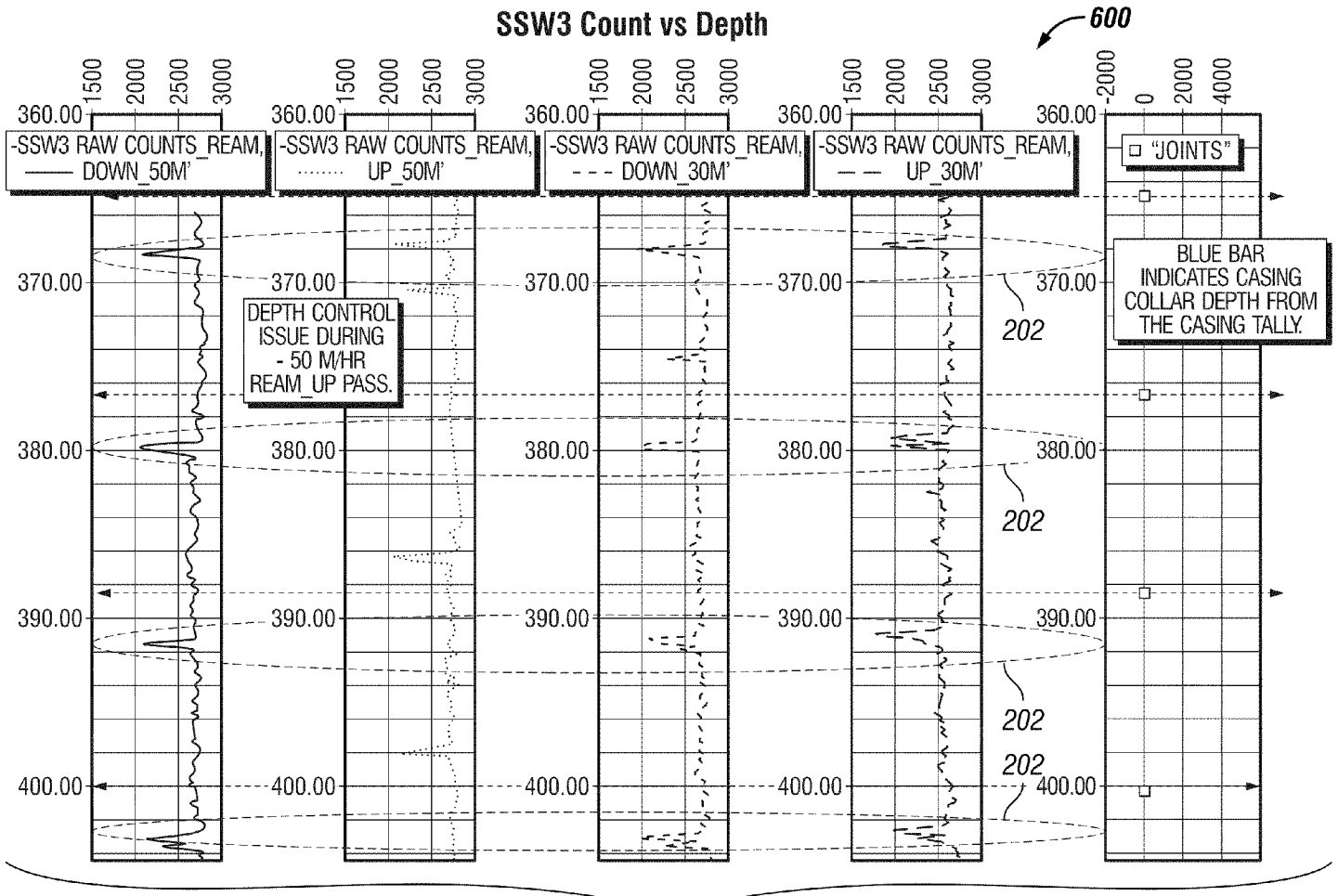
FIG. 7 illustrates a graph for identifying one or more features of a well casing via density measurements obtained by a downhole tool in an embodiment of the present specification.

Additionally, FIG. 7 illustrates a graph 600 for gamma-gamma density measurements detected by the downhole component 36 and processed by the downhole component 36 and/or the surface controller 48. In embodiments, the downhole component 36 may be a LWD azimuthal density neutron (hereinafter "ADN" tool). Graph 600 may represent or correspond to detector count rates that may be utilized in computation of photoelectric values and/or determination of gamma gamma density. The measured and detected density photoelectric measurements (see FIGS. 6 and 7, respectively) may momentarily increase to larger values or spikes 202 at regular intervals. The spikes 202 may identify the presence and/or the location of the one or more casing collar joints 104. Moreover, the spikes 202 may be a result of variations of metal density at the casing collar joints 104 when compared to the metal density at the well casing 26 without the casing collar joints 104.

The measurements detected and/or measured by the downhole component 36 may allow for real time identification of the one or more casing collar joints 104 of the well casing 26. The downhole component 36 may move uphole and/or downhole at a velocity to detect and/or measure the properties along a portion of or an entire length of the well casing 26. The velocity of movement by the downhole component 36 may be, for example, about thirty (30) meters per hour, about forty (40) meters per hour or about fifty (50) meters per hour and/or the like. By utilizing the velocity of movement for the downhole component 36, data density measurements of at least 6 data points may be obtained and/or measured for every meter that may be logged by the downhole component 36. The present disclosure should not be deem limited to a specific velocity of movement for the downhole component 36.

Figure 8:
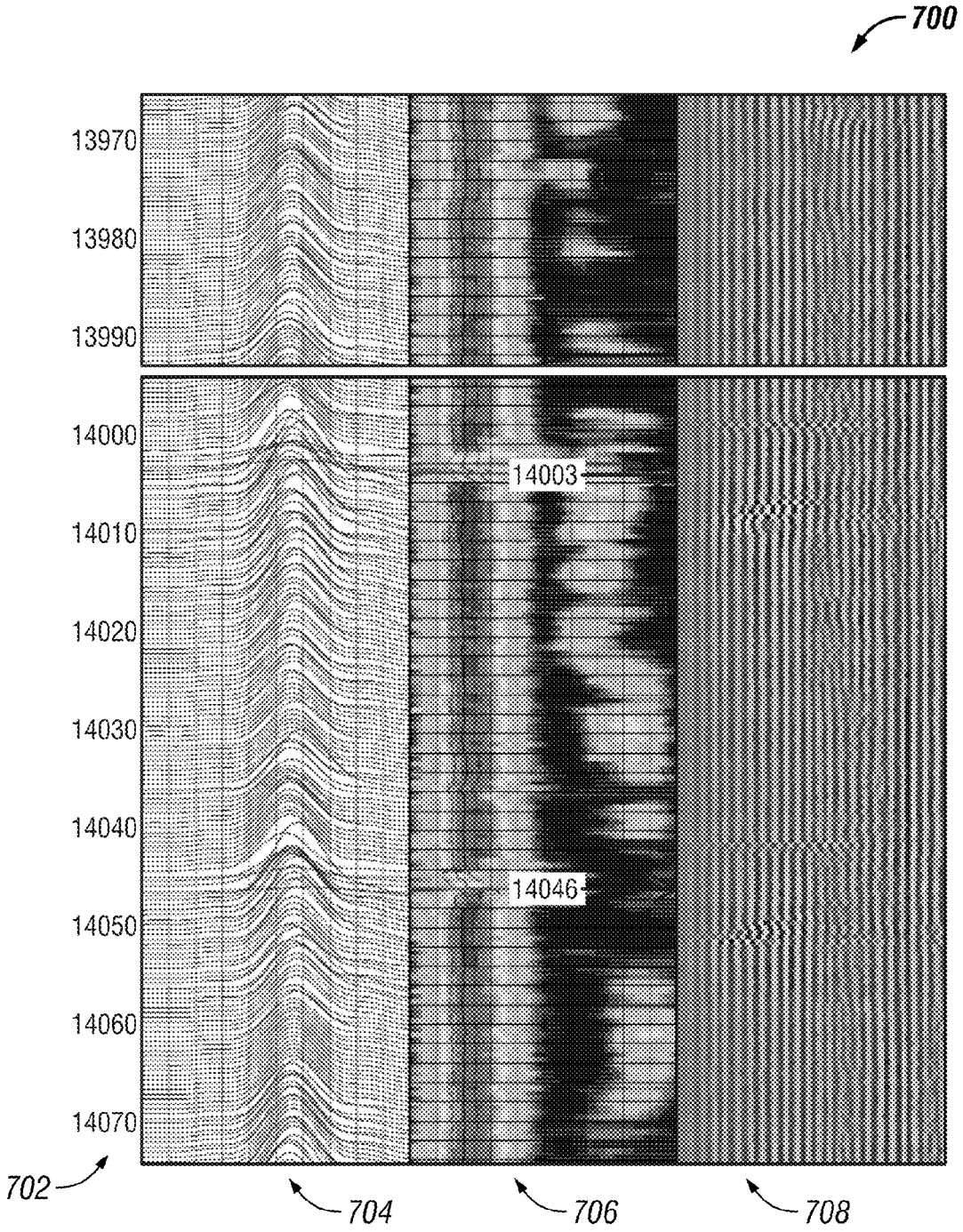
FIG. 8 illustrates a graph includes sonic Slowness Time Coherence (hereinafter "STC") projections and Variable Density Log (hereinafter "VDL") waveforms for identifying one or more features of a well casing in an embodiment of the present specification.
Figure 9:
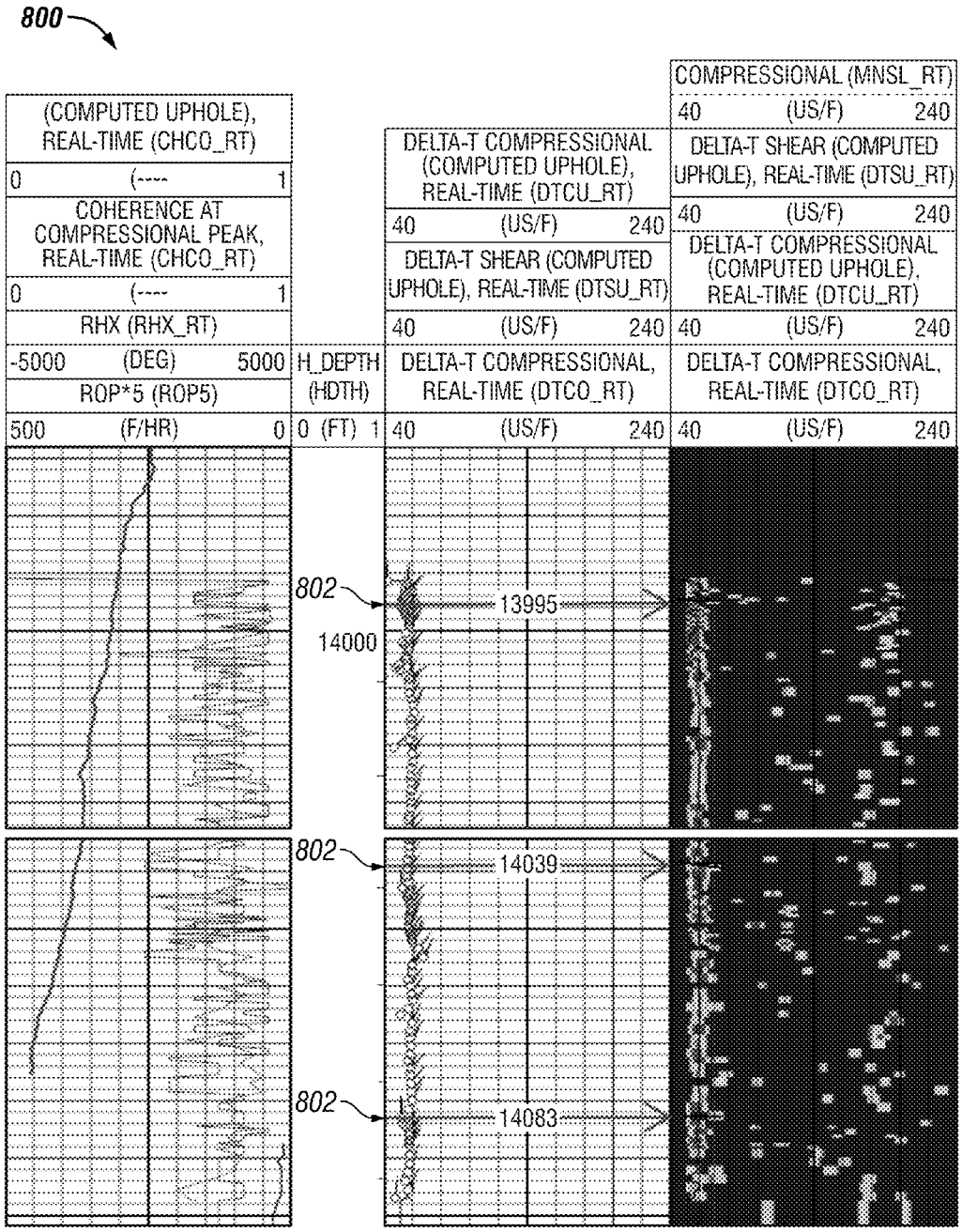
FIG. 9 illustrates a graph including real time mud pulse transmissions of sonic STC projections and slowness for identifying one or more features of a well casing in an embodiment of the present specification.

FIGS. 8 and 9 illustrate graphs 700 and 800, respectively, for measurements relating to one or more properties, such as acoustical properties associated with the features and/or the one or more casing collar joints 104 which may be detected and/or measured by the downhole component 36. The data and/or measurements may be stored in a memory (not shown in the drawings) of the downhole component 36 or, alternatively, may be transmitted, in real time, uphole to surface controller 48. The measurements may be processed by the downhole component 36 and/or the surface controller 48 to identify the presence and/or the location of the one or more casing collar joints 104 in real time or at a different time.

Graph 700 of FIG. 8 identifies the one or more casing collar joints 104 based on sonic STC projections and normal waveform VDL. FIG. 8 may include more than one track, such as, for example four tracks. In FIG. 8 a first track 702 may represent a depth; a second track 704 may represent a coherence amplitude; a third track 706 may represent a STC plane; and a fourth track 708 may represent a normal waveform VDL. The one or more casing collar joints 104 may be identified and/or detected by a lack of coherence in the STC plane. Moreover, the normal waveform VDL may show a scattering of the waveform as the downhole component 36 may be positioned near and/or adjacent to the one or more casing collar joints 104. Thus, the one or more casing collar joints 104 may be located near or about the middle of the scattering of the waveform in the normal waveform VDL.

Graph 800 of FIG. 9 illustrates real time mud pulse transmission measurements of sonic STC projections and slowness used for identification of the one or more casing collar joints 104. The measurements may be processed by the downhole component 36 and/or the surface controller 48. Specifically, FIG. 9 shows real time measurements illustrate a loss of coherence in the STC plane (as shown in the track located on the right side of graph 800) which may result in a momentarily increase to larger values or horizontal spikes in the computation of the compressional slowness to identify the one or more casing collar joints 104. The horizontal spikes in FIG. 9 may represent one or more casing collar joints 104 as identified by horizontal arrows 802 at various depths.

In embodiments, after the position or location of the one or more casing collar joints 104 may be identified, the whipstock may be placed between the one or more casing collar joints 104 such that a window (not shown in the drawings) may be milled into the side of the well casing 26 between the one or more casing collar joints 104. However, if the one or more casing collar joints 104 is mistakenly drilled for placement of the whipstock, the inclusion of the whipstock may not be successful because material(s) of the one or more casing collar joints 104 may be harder and thicker than material(s) of the well casing 26 without the casing collar joints 104. As a result, the possibility of parting the well casing 26 to form the window for inclusion of the whipstock may be greatly reduced or may be incapable of being achieved.

Figure 10A:
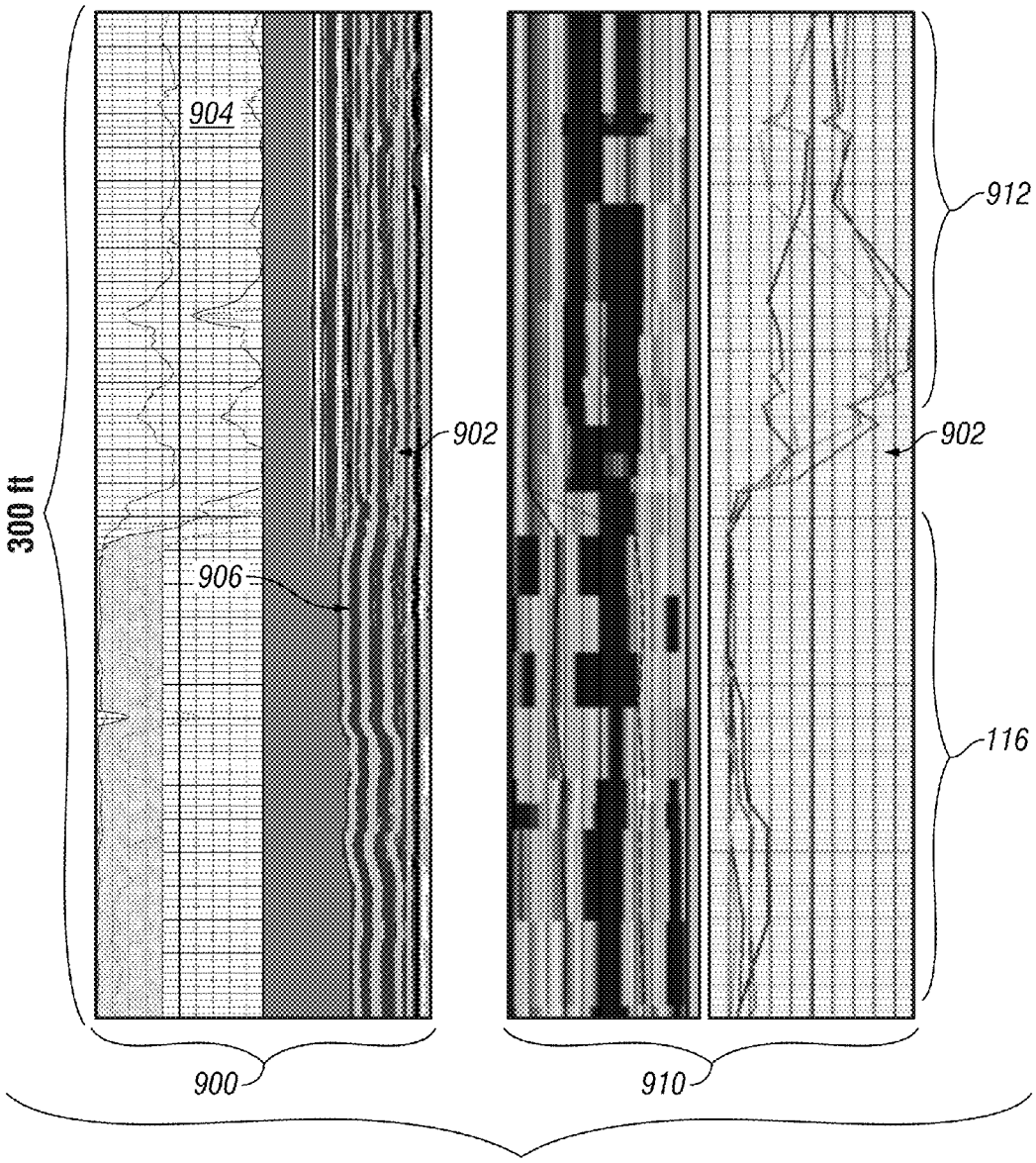
FIG. 10A illustrates a graph including sonic receiver waveforms for identifying one or more features of a well casing in an embodiment of the present specification.
Figure 10B:
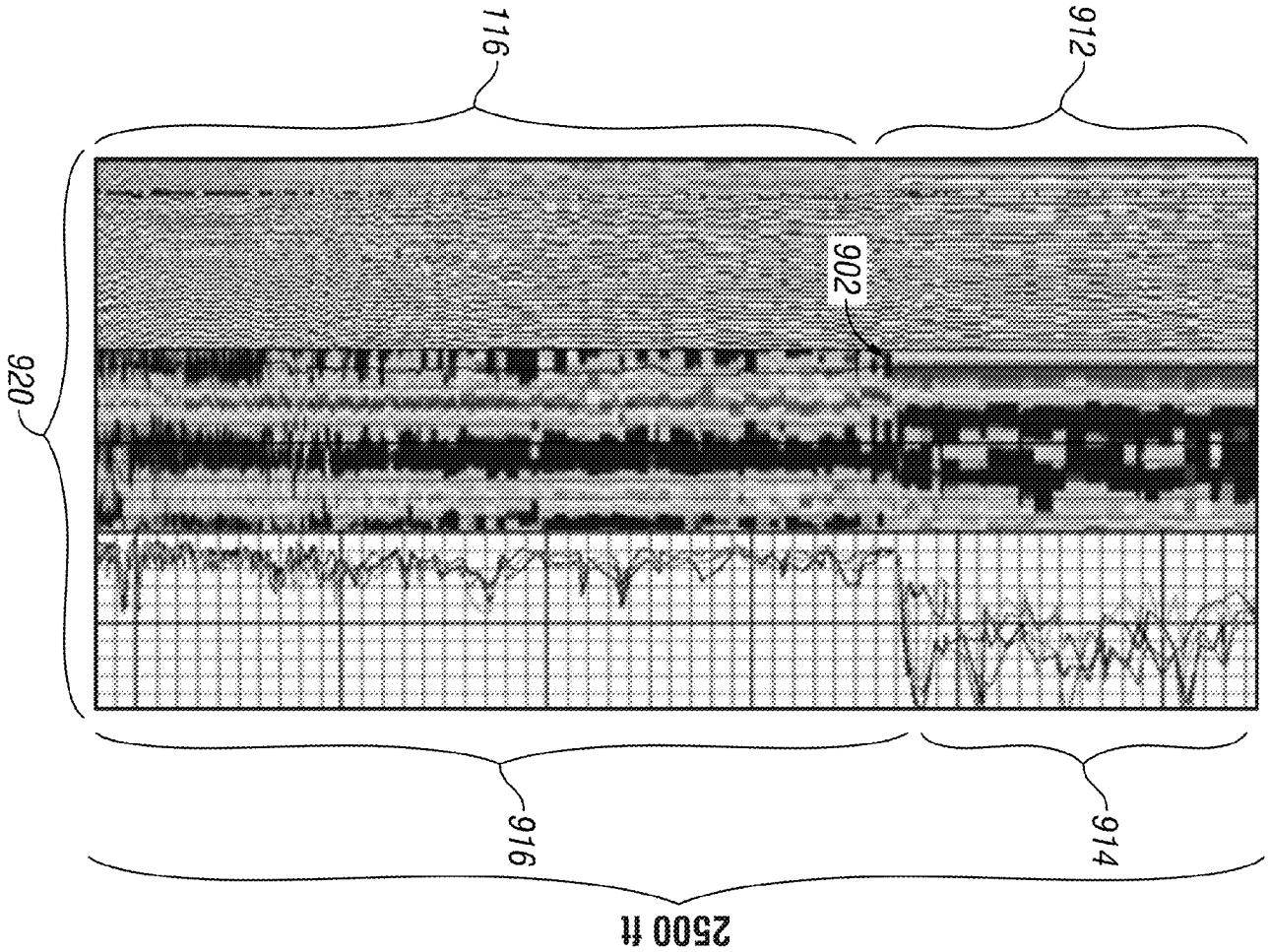
FIG. 10B illustrates a graph including sonic receiver waveforms for identifying one or more features of a well casing in an embodiment of the present specification.

Graphs 900 and 910 of FIG. 10A and Graph 920 of FIG. 10B illustrate sonic receiver measurements for identifying and/or determining a location of an upper top end 902 of cement 116 (as shown FIG. 2) and a degree of cement bond quality. During the drilling of the wellbore 14, the cement 116 may be injected through the wellbore 14 and may rise up the annulus 18 between the well casing 26 and the formation 15. The cement bond quality refers to a quality of a bond between the well casing 26 and the cement 116 placed in the annulus 18 between the well casing 26 and the wellbore 14 and/or a bond between the cement 116 and the formation 15.

Graph 900 of FIG. 10A shows a wireline cement bond log over a distance of three hundred (300) feet into the wellbore 14, Graph 910 of FIG. 10A shows a Sonicvision log over a distance of three hundred (300) feet into the wellbore 14. Graph 920 of FIG. 10B shows a sonic log obtainable by a LWD tool which measures velocity of a propagating sound wave through a formation penetrated by a wellbore over a distance of twenty-five hundred (2500) feet into the wellbore 14. In embodiments, the waveform VDL for the sonic log in FIG. 10B may be, for example, 40-240 μs/ft. An upper top end 902 of the cement 116 may be marked by an appearance of well casing 26 at early times in the measurements, such as, for example, the waveform VDL detected and/or measured by the downhole component 36.

The wireline cement bond log in Graph 900 of FIG. 10A illustrates that a straight waveform VDL 904 may be separated from a dynamic delta T (hereinafter "DT") waveform 906 at the upper top end 902 of the cement 116 in the wellbore 14. Additionally, the Sonicvision log in FIG. 10A and the Sonicvision JTQC log in FIG. 10B illustrate that no cement 912 and high amplitudes 914 are present at and/or associated with locations above the upper top end 902 of the cement 116 in the wellbore 14 and that the cement 116 and low amplitudes 916 are present at and/or associated with locations below the upper top end 902 of the cement 116 in the wellbore 14. Moreover, when the cement 116 may be present in the wellbore 14, the amplitude may be inversely proportional to the degree of bonding between the cement 116 and the well casing 26 or the cement 116 and the formation 15.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A system for identifying a casing collar joint of a well casing located within a wellbore, the system comprising:

a downhole component associated with the wellbore, wherein the downhole component is configured to obtain one or more sonic measurements associated with the casing collar joint of the well casing via (i) transmitting sound waves towards the well casing and (ii) receiving sonic waves reflected back from the well casing, and a controller configured to identify a location of the casing collar joint based on a sonic slowness time coherence projection, the controller configured to generate a slowness time coherence plane from said one or more sonic measurements and to identify the location of the casing collar joint by a lack of coherence in the slowness time coherence plane.

2. The system of claim 1, wherein the downhole component is a logging-while-drilling tool or a wireline configurable tool.

3. The system of claim 1, wherein the controller is further configured to identify the location of the casing collar joint via the sonic slowness time coherence projection by an increase in compressional slowness caused by the lack of coherence in the slowness time coherence plane.

4. The system of claim 1, wherein:

the controller is configured to identify a location of the casing collar joint by further generating a normal waveform variable density log from said one or more sonic measurements and identifying the location of the casing collar joint by a scattering in the normal waveform variable density log.

5. The system of claim 4, wherein the controller is configured to identify the location of the casing collar joint at an approximate midpoint of the scattering in the normal waveform variable density log.

6. The system of claim 1, wherein the controller is connected to and in communication with the downhole component via a communication link.

7. The system of claim 4, wherein the communication link is a wired drill pipe or a telemetry module.

8. A method for identifying a casing collar joint of a well casing located within a wellbore, the method comprising:

deploying a downhole component in the wellbore, the downhole component configured to obtain one or more sonic measurements associated with the casing collar joint of the well casing;

causing the downhole component to obtain the one or more sonic measurements via (i) transmitting sound waves towards the well casing and (ii) receiving sonic waves reflected back from the well casing; and causing a controller to identify a location of the casing collar joint based on a sonic slowness time coherence projection via (i) generating a slowness time coherence plane from said one or more sonic measurements and (ii) identifying the location of the casing collar joint by a lack of coherence in the slowness time coherence plane.

9. The method of claim 8, wherein the one or more measurements exclude electromagnetic measurements.

10. The method of claim 8, wherein the downhole component is a wireline tool.

11. The method of claim 8, further comprising:

determining a measured depth based on the location of the casing collar joint of the well casing; and performing a downhole action based on the measured depth.

12. The method of claim 8 wherein the controller further identifies the location of the casing collar joint based on the sonic slowness time coherence projection via (iii) identifying the location of the casing collar joint by an increase in compressional slowness caused by the lack of coherence in the slowness time coherence plane.

13. The method of claim 8, further comprising:

causing the controller to identify the location of the casing collar joint by (iii) generating a normal waveform variable density log from said one or more sonic measurements and (iv) identifying the location of the casing collar joint by a scattering in the normal waveform variable density log.

14. The method of claim 13, wherein the controller is configured to identify the location of the casing collar joint at an approximate midpoint of the scattering in the normal waveform variable density log.

15. The method of claim 8, further comprising:

electrically connecting the controller to the downhole component via a communication link, wherein the controller receives at least one signal from the downhole component and identifies the location the casing collar joint of the well casing based on the slowness time coherence projection.

16. The method of claim 15, wherein the communication link is a wired drill pipe or a telemetry module.

17. The method of claim 15, further comprising:

transmitting the one or more sonic measurements from the downhole component uphole to the controller in real time.

* * * * *